United States Patent [19]

Montabert

[11] 4,308,926

[45] Jan. 5, 1982

[54] PNEUMATICALLY CUSHIONED PERCUSSION APPARATUS

[75] Inventor: Roger Montabert, Bron, France

[73] Assignee: Etablissements Montabert S.A., Saint-Priest, France

[21] Appl. No.: 149,648

[22] Filed: May 14, 1980

[30] Foreign Application Priority Data

May 15, 1979 [FR] France ..... 79 13278

[51] Int. Cl.[3] ..... F21B 3/00

[52] U.S. Cl. ..... 173/162 R; 173/139

[58] Field of Search ..... 193/162 R, 162 H, 139

[56] References Cited

U.S. PATENT DOCUMENTS

| | | | |
|---|---|---|---|
| 2,748,750 | 6/1956 | Altschuler | 173/162 |
| 2,899,934 | 8/1959 | Salengro | 173/162 H |
| 3,010,431 | 11/1961 | Holdo | 173/162 |
| 3,223,181 | 12/1965 | Price | 173/162 X |
| 3,255,832 | 6/1966 | Leavezl | 173/162 |
| 3,788,404 | 1/1974 | Koudelka et al. | 173/139 |
| 4,068,727 | 1/1978 | Andersson | 173/139 |

FOREIGN PATENT DOCUMENTS

| | | | |
|---|---|---|---|
| 804653 | 10/1936 | France | 173/162 |
| 457594 | 3/1975 | U.S.S.R. | 173/162 |
| 716805 | 2/1980 | U.S.S.R. | 173/162 H |

*Primary Examiner*—Ronald Feldbaum
*Attorney, Agent, or Firm*—Karl F. Ross

[57] ABSTRACT

A percussion tools such as a pneumatic hammer, drill, concrete braker and the like in which a ram is pneumatically reciprocated in a cylinder to drive a tool, has a head provided with the handles gripped by the user and forming a pneumatic cushion with the cylinder. According to the invention, this head carrying the handles is mounted with slight clearance slidably on the cylinder and the pneumatic cushion is formed between the upper end of the cylinder and the interior of the head. A sleeve attached to the head and surrounding the cylinder communicates with the cylinder through the usual reciprocation-producing valve and a portion of the air pressure is bled through the clearance into the cushion. A vent passage of the cylinder communicates with the cushion chamber and can register with a passage in the sleeve opening into the atmosphere.

5 Claims, 3 Drawing Figures

PNEUMATICALLY CUSHIONED PERCUSSION APPARATUS

FIELD OF THE INVENTION

My present invention relates to percussion apparatus and, more particularly, to a shock-damping or pneumatically cushioned percussion tool such as a pneumatic hammer, drill, breaker or the like which limits the stress applied to the operator.

BACKGROUND OF THE INVENTION

Pneumatic percussion apparatus such as pneumatic drills, picks, concrete or rock breakers and the like essentially comprise a cylinder within the interior of which a ram or hammer is axially reciprocated by a reciprocating valve controlling the feed of compressed air to the cylinder, the ram or hammer functioning as a piston which drives a tool such as a chisel, pick or drill.

This ram is subjected to linearly reciprocating movement under the pneumatic control, i.e. is driven downwardly by pneumatic pressure until at the end of its stroke it impacts against the upper end of the tool or an anvil affixed thereto.

The tool can be received in a guide bushing which itself is slidable in the cylinder and forms a guide not only for the tool but also for the lower end of the ram and positions the tool shank in axial alignment with the ram.

The air-distribution valving systems for such devices, which can alternately feed the compressed air to the opposite side of the ram, are well known in the art, likewise are provided on such devices.

It is customary to form the upper end of the cylinder with a pair of handles which can be gripped by the operator, one of which can be equipped with a trigger or actuating lever which operates a feed valve for admitting the compressed air to the distribution system to turn on and off the pneumatic reciprocating or hammer action which is automatic when the latter valve is open and is precluded when this valve is closed.

In the use of such tools, the reaction of the forces generated by the compressed air upon the cylinder on the one hand and the return of the shock wave generated by the impact of the ram against the pick on the other hand, especially when the pick is in contact with a hard material such as rock or concrete, imparts to the cylinder vibratory movements which are transmitted to the hand and to the user of a frequency and energy which may vary but high values can affect the blood circulation of the user and the joints of the extremities of an operator. These vibrations are readily transmitted to the hands of the operator and thus through the body of the individual gripping the handles.

In order to reduce the vibratory movement which is detrimental to the health of the operator it has already been proposed to decouple the movement of the cylinder from that of the handles by providing an assembly which is slidably mounted on the upper end of the unit and carries the handles. A cushioning or shock-damping chamber is provided between this assembly and the upper end of the apparatus (see, for example, French Pat. No. 2,136,469).

This shock-absorbing chamber is supplied with air in the earlier system with a feed arrangement that has been found to create difficulties. For example, when the passages feeding the shock-absorbing chamber have a significant flow cross section, the pressure drop makes the pneumatic hammer significantly less effective. When, however, smaller flow cross sections are provided to avoid a significant pressure drop, they are readily obstructed by contaminants which are practically unavoidably entrained with the compressed air.

Thus the conventional system has been found to suffer from a significant energy loss on the one hand or possible obstruction of the passage which feeds the shock absorber chamber on the other so that the apparatus has either been inefficient or incapable of sufficiently protecting the user.

OBJECTS OF THE INVENTION

It is the principal object of the present invention to provide an improved pneumatic apparatus especially a percussion apparatus such as a pneumatic hammer, drill, pick or breaker, whereby the aforementioned disadvantages can be obviated.

Another object of this invention is to provide an improved pneumatic percussion apparatus having an effective vibration-transmission damping with a minimum of energy loss.

SUMMARY OF THE INVENTION

These objects and others which will become apparent hereinafter are attained, in accordance with the present invention, in a pneumatic percussion apparatus provided with a shock-damping arrangement and which comprises a cylindrical body (cylinder) formed with an internal bore in which a piston or ram is slidably mounted and can be driven pneumatically into engagement with a tool extending into the lower end of the cylinder.

At the upper end of the cylinder, there is provided a shock-damping assembly which is slidable axially relative to the cylinder and provided with the handles for enabling manipulation of the apparatus. This assembly defines between its inner wall and the upper end of the cylinder, a shock-damping chamber fed with compressed air by a feed system provided on the assembly carrying the handles.

According to the invention, this slidable assembly carrying the handles comprises a head surrounding the upper end of the cylinder with a predetermined annular clearance or play with the shock-damping chamber being fed with compressed air through this clearance. At least one passage is provided in the cylinder between this chamber and an orifice on the wall of the cylinder body which can register with a passage on the assembly or head opening into the atmosphere so that the flow cross section between the latter venting passage and the orifice varies as a function of the relative axial positions of the cylinder body and the assembly, i.e. the head.

The head assembly thus is pneumatically suspended by an air cushion fed through the slight annular clearance which thus limits the consumption of the compressed air, the cushion of air being vented variably so that the cushioning effect is proportioned to the axial force applied by the user.

Since the cushion is fed through the annular clearance defined between a pair of relatively axially moving walls a self-cleaning operation is guaranteed and the clearance remains unobstructed even when the compressed air is contaminated.

According to a feature of the invention, the assembly comprises, in addition to the aforementioned head, a sleeve mounted on the head and defining the annular clearance with the cylinder body, i.e. surrounding the upper end of the cylinder body. This sleeve is formed with an annular compartment fed with the compressed air and communicating through at least one and preferably a plurality of radial orifices which open into the aforementioned clearance and are aligned with one or more passages formed in the upper end of the cylinder body and communicating with the air distribution system for pneumatically reciprocating the ram or piston. The head can be formed in one piece with the handles and the sleeve can be bolted to this head which can enclose the upper end of the cylinder body. The head defines the cushion chamber and may form abutments limiting the relative axial displacement of the cylinder body and the assembly.

Advantageously, the orifices of the sleeve register with similarly shaped orifices in the upper end of the cylinder body which communicate with the passages of the air distribution system for reciprocating the ram. It will be apparent that this arrangement feeds the cushion chamber with leakage air traversing the clearance between the assembly and the upper end of the cylinder body.

BRIEF DESCRIPTION OF THE DRAWING

The above and other objects, features and advantages will become more readily apparent from the following description, reference being made to the accompanying drawing in which.

SPECIFIC DESCRIPTION

Figure 1:
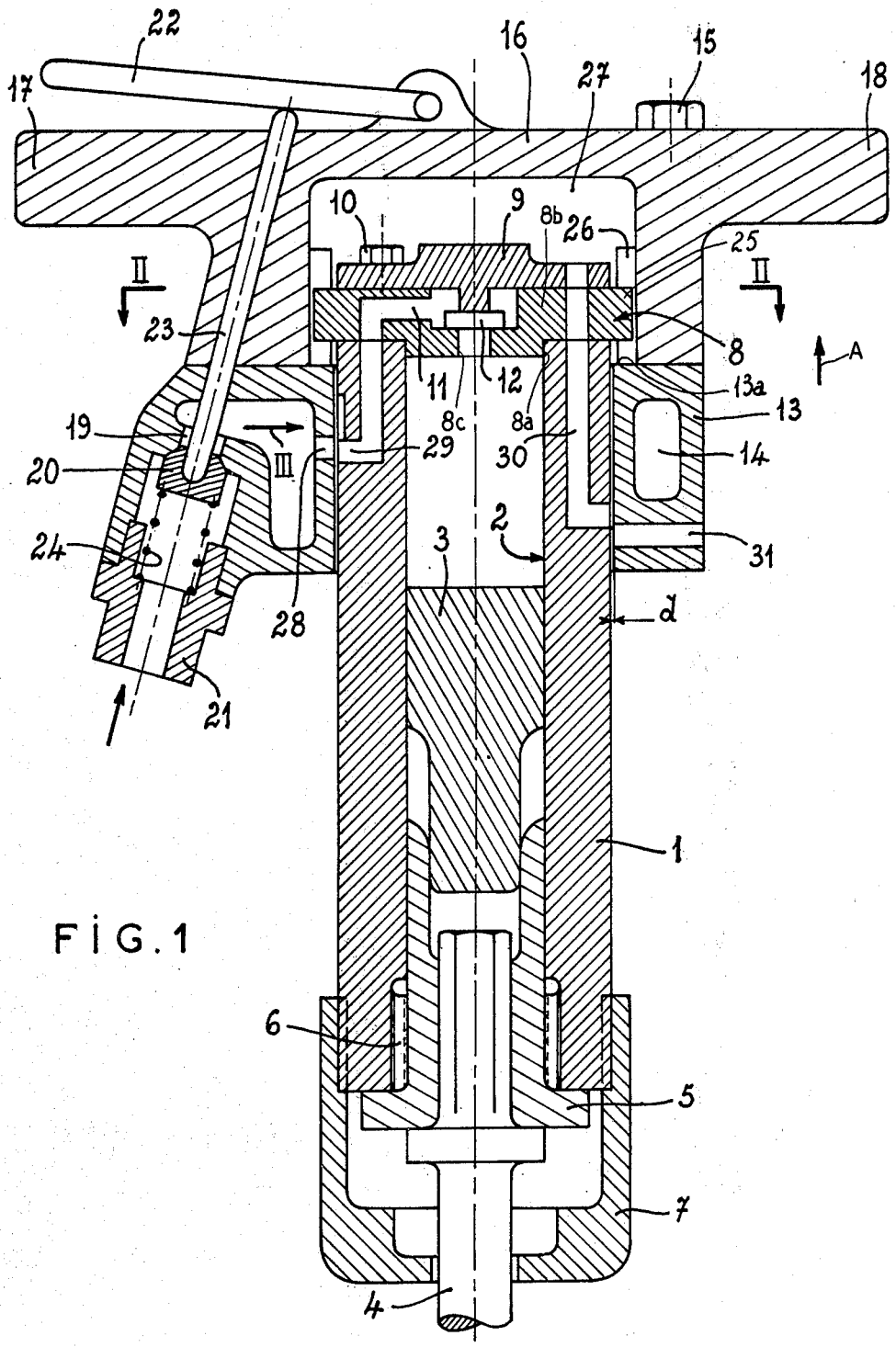
FIG. 1 is an axial cross-sectional view through a pneumatic percussion apparatus embodying the invention with portions conventional in the art being shown diagrammatically.
Figure 2:
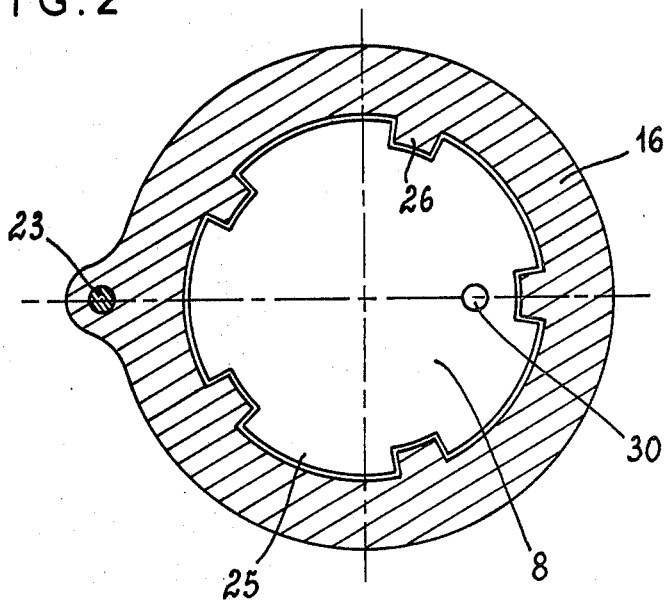
FIG. 2 is a cross-sectional view taken along the line II—II of FIG. 1.
Figure 3:
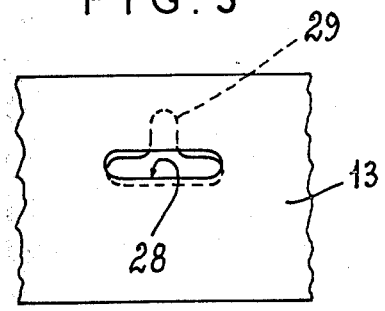
FIG. 3 is a view taken in the direction of arrow III of FIG. 1.

In FIGS. 1 through 3 I have shown a pneumatic hammer of the type used to break concrete slabs and like structures and in which the automatic valve system for recipricating the ram has been illustrated only diagrammatically. The system may make use of the arrangement of the French patent mentioned previously or any conventional automatic valve system capable of reciprocating the ram, preferably by alternatively venting the cylinder chamber on one side and pressurizing the chamber on the opposite side.

The apparatus comprises a cylinder 1 whose bore 2 slidably receives a piston or ram 3 whose lower end is aligned with the upper end or shank of a pick 4 representing the tool which can be removably mounted in the pneumatic hammer.

The shank or pick 4 is received in a guide brushing 5 which is axially shiftable and slidable in the lower end of cylinder bore 2 so that it can follow the movement of pick 4 when it is driven downwardly.

For the concrete-breaking hammer of FIGS. 1 through 3, the angular position of the pick relative to the cylinder 1 is maintained by splines 6 formed on the inner wall of the lower end of the cylinder and the outer wall of the bushing 5.

The cylinder is closed at its lower end by a cap 7 having a central bore through which the pick can pass. At its upper end the cylinder is closed by two plates 8 and 9 secured by bolts 10 to the cylinder, only one of these bolts being shown in the drawing.

Plate 8 is formed with a central boss **8*a* which fits snugly into bore 2 and has a flange 8*b* which is channeled as will be described in greater detail below so that overhangs 25 abut a shoulder 13*a* of a sleeve 13 to limit the upward movement thereof in the direction of arrow A. A central passage 8*c* is formed in this plate 8 and cooperates with a distribution valve 12 shown only diagrammatically but serving the function mentioned above of alternately driving the ram 3** downwardly and effecting its upward movement.

Access to the valve system 12 may be had by removal of the plate 9.

The plates 8 and 9 thus close the distribution system for the compressed air which includes, in addition to the feed passage 11, the distribution valve 12 which has been shown diagrammatically.

The upper part of the cylinder 1 has a circular cross section and is surrounded slidably by the sleeve 13 which defines an annular clearance having a radial width d between the outer surface of cylinder 1 and the inner surface of the sleeve 13.

The sleeve 13 is formed with an annular compartment 14 completely surrounding the cylinder 1.

Above the sleeve 13, there is provided a head 16 which is connected to the sleeve by means of screws, one of which can be seen at 15. The head 16 is formed with a pair of diagrammatically opposite lateral handles 17 and 18.

Compartment 14 is provided with an inlet orifice 19 which can be blocked by a valve member 20 urged by a coil spring 24 into the closed position shown in FIG. 1. This valve member which controls the feed of compressed air delivered to a fitting 21 against an inner shoulder of which the spring 24 is seated, is manually actuated by a trigger 22 associated with the handle 17 and acting upon a push rod 23 extending through the head 16.

As has been shown in greater detail in FIG. 2, the closure plate 8 is provided on its periphery with the ledges 25 which are received in grooves defined between ribs 26 of the head 16 to permit axial sliding of the head on the cylinder 1 but angularly connecting them so that the tool 4 can be rotated by twisting of the tool via the handles 17 and 18. If the ribs 26 and the grooves in plate 8 are pitched, an angular displacement can automatically be provided for the body 1 and hence the tool 4.

Between the inner wall of the head 16, the plates 8 and 9 and the cylinder wall above the sleeve 13, there is formed a shock-damping cushion chamber 27 whose volume varies as a function of the relative axial positions of the cylinder 1 and the assembly formed by the sleeve 13 and the head 16.

This relative axial displacement is limited on the one hand by engagement of plate 9 against the upper end of chamber 27 and, on the other hand, by the engagement of the overhangs 25 against the shoulder **13*a*** previously described.

Orifices 28 are provided between the annular compartment 14 of sleeve 13 and the internal bore thereof. These orifices 28 register with other orifices 29 formed in the periphery of cylinder 1 and connected to the passages 11 of the distribution system previously described.

As can be seen from FIG. 3, the orifices 28 are of oblong shape while the orifices 29 have the configuration of an inverted T.

The pairs of orifices 28, 29 are advantageously disposed in axially symmetric relationship, for example in two diametrically opposed pairs, to ensure lateral equilibrium of the forces generated by the air pressure.

A passage 30 is also formed in cylinder 1 and the closure plates 8, 9 parallel to the axis of the cylinder and communicating with chamber 27.

At its lower end, the passage 30 opens at an orifice which registers, at the periphery of the cylinder, with vent passages 31 formed in a sleeve 13 and opening into the atmosphere.

Compressed air, admitted to the annular compartment 14 by opening of valve 20, thus passes through orifices 28 toward the cylinder 1. A small portion of this air leaks or bleeds through the clearance d between the cylinder 1 and sleeve 13 to the chamber 27. The major portion of the air, without material pressure drop, passes through the orifices 29 into the distribution system 11, 12 to reciprocate the piston 3 in the conventional manner.

The air admitted into chamber 27 through the clearance d raises the assembly formed by sleeve 13 and the head 16 with the handles 17 and 18 into a position in which the passage 30 registers with passage 31 to vent the cushion 17.

As a result, an equilibrium is established between the quantity of air admitted to chamber 27 and the quantity of air discharged therefrom.

Movement of the assembly constituted by cylinder 1, piston 3, bushing 5 and the closure plates 8 and 9 results, for an apparatus gripped by the user, in slight variations of the pressure of air in chamber 27.

By selection of the volume of this chamber with respect to the volume displaced by movement of the cylinder 1 and the mass of the assembly 13, 16–18, and with respect to the frequency of movement of the cylinder, it is possible to reduce the acceleration transmitted to the handles 17 and 18 to a value which is completely tolerable for continuous work.

The relative position of the orifices 28 and 29 is a function of the force applied by the operator upon the head and, since this controls the feed of air, it is possible to vary the force applied during work by simply increasing or decreasing the pressure on the handles. In practice this has been found to be advantageous since it allows fine control of the percussion operation without undue acceleration upon the handles.

The system eliminates the transmission of vibration to the handles which may be detrimental to the health of the user and provides automatic control of the compressed air and of the power of the percussion carried out thereby.

While the invention has been described particularly in connection with pneumatic hammers, it is equally applicable to other pneumatic tools where similar problems arise.

I claim:

1. A pneumatic percussion apparatus comprising:

a body forming a cylinder;

a ram reciprocatable pneumatically in said cylinder;

means for mounting a tool adapted to be impacted by said ram at one end of said body; and a shock-damping assembly on the opposite end of said cylinder, said assembly being mounted on said other end of said body and defining an annular clearance therewith and a shock-damping chamber between said body and said assembly communicating with said clearance, said assembly comprising a valve connectable to a source of compressed air for feeding a distribution system in said body for reciprocating said ram across said clearance, said body being provided with a passage communicating with said chamber and registerable with a vent in said assembly for establishing an equilibrium between compressed air fed to said chamber through said clearance and air discharged from said chamber through said passage.

2. The apparatus defined in claim 1 wherein said shock-damping assembly comprises a head defining said chamber with the upper end of said body, and a sleeve surrounding said upper end of said body and defining said clearance therewith, said head being formed with a pair of handles and at least one actuator for said valve associated with one of said handles, said valve being provided in said sleeve, said sleeve being formed with an annular compartment communicating with said valve and provided with at least one orifice opening into said clearance, said distribution system including an orifice formed in said body and registering with said orifice of said sleeve.

3. The apparatus defined in claim 2 wherein in orifice of said sleeve has an oblong shape while the orifice of said body has an inverted T configuration.

4. The apparatus defined in claim 3 wherein said orifices form a pair, a plurality of pairs of such orifices being disposed symmetrically about the axis of said cylinder.

5. The apparatus defined in claim 1, claim 2, claim 3 or claim 4 wherein said head is provided with a lever, said valve being formed in said sleeve and having an actuating rod extending through said head and engageable by said lever, said upper end of said body being provided with a pair of cylinder closure plates forming said distribution system and limiting relative axial displacement of said assembly and said body, said means for mounting said tool in said cylinder including a bushing axially slidable therein.

* * * * *